US009520108B1

(12) United States Patent
Powers

(10) Patent No.: US 9,520,108 B1
(45) Date of Patent: Dec. 13, 2016

(54) INTERNAL BRACING FOR A GUITAR

(71) Applicant: TAYLOR-LISTUG, INC., El Cajon, CA (US)

(72) Inventor: Andrew Taylor Powers, Carlsbad, CA (US)

(73) Assignee: TAYLOR-LISTUG, INC., El Cajon, CA (US)

( * ) Notice: Subject to any disclaimer, the term of this patent is extended or adjusted under 35 U.S.C. 154(b) by 0 days.

(21) Appl. No.: 14/887,422

(22) Filed: Oct. 20, 2015

(51) Int. Cl.
*G10D 1/08* (2006.01)

(52) U.S. Cl.
CPC ..... *G10D 1/08* (2013.01)

(58) Field of Classification Search
CPC ..... G10D 1/08; G10D 1/085; G10D 1/005; G10D 1/00; G10D 17/00; B27D 1/08; B27H 1/00
USPC ..... 84/267, 290, 291
See application file for complete search history.

(56) References Cited

U.S. PATENT DOCUMENTS 4,079,654 A 3/1978 Kasha
4,084,475 A * 4/1978 Horowitz ..... G10D 3/02 84/291
4,291,606 A 9/1981 Lepage
5,339,718 A 8/1994 Leduc
5,469,770 A 11/1995 Taylor
5,952,592 A 9/1999 Teel
6,693,233 B1 * 2/2004 Sewell ..... G10D 1/08 84/267
6,933,428 B1 8/2005 Pedgley et al.
7,411,121 B2 8/2008 McGill
8,378,191 B2 2/2013 Barillaro
9,000,282 B1 4/2015 Booth

OTHER PUBLICATIONS

Werner, Bradford—"This is Classical Guitar," Webpage: http://www.thisisclassicalguitar.com/bracing-styles-for-classical-guitars/, 2015.

* cited by examiner

*Primary Examiner* — Kimberly Lockett
(74) *Attorney, Agent, or Firm* — Patterson & Sheridan, LLP

(57) ABSTRACT

A guitar top includes a sound hole, a neck end that is configured for attachment to a guitar neck with a longitudinal axis, a heel end, a transverse axis normal to the longitudinal axis, and a bottom surface. The bottom surface of the guitar top includes a pair of longitudinal braces that are attached to the surface. The pair of longitudinal braces extend primarily along the longitudinal axis from the heel end toward the neck end and terminate at a point beyond the sound hole toward the neck end. Each of the longitudinal braces is positioned on an opposing side of the sound hole such that a distance between the longitudinal braces exceeds the diameter of the sound hole.

25 Claims, 3 Drawing Sheets

INTERNAL BRACING FOR A GUITAR

BACKGROUND OF THE INVENTION

Field of the Invention

Embodiments of the present invention generally relate to a flat top guitar. More particularly, the invention relates to an improved bracing structure for a guitar top.

Description of the Related Art

The bodies of instruments such as flat top guitars commonly utilize a round or oval shaped sound hole in the guitar top, beneath the strings, in front of the bridge, or point of attachment for the strings. This opening creates a structurally weak spot allowing string tension to create physical distortions in the body of the guitar, potentially rendering the guitar non-functional. Structural members, such as braces, are required to counteract this deformation. As well as counteracting deformation from string tension, the structural members are required to conduct and distribute vibration from the strings to assist in even vibration of the resonant chamber, or body, of the guitar.

Instruments with strings attached to the center of the vibrating diaphragm in the manner of conventional flat top guitars, are inefficient amplifiers of string energy. Much of the inertia imparted by the musician into the vibrating string is dissipated and lost through the supporting members of an instrument, rather than being amplified by the body of the instrument. This lost energy reduces the potential volume, sustain, and responsiveness in a string instrument.

The action of vibrating strings is governed largely by the structure the strings are anchored to and tensioned across. The more rigid the structure is made, the more the structure is resistant to vibrating. A structure resistant to vibrating will absorb little of the string's energy allowing the string to continue vibrating for an extended length of time. This characteristic of a rigid supporting structure and corresponding longer sustaining string vibration is manifested in a long sustaining musical tone of the instrument; this quality is a benefit to the musician performing on such an instrument.

The disadvantage of a rigid supporting structure is the imparted limitation on vibration directly impacts the ability of the structure to resonate and convert the vibration of the strings into audible volume. Volume is measured in amplitude of vibration. Great volume is necessary for a musical instrument to amplify the vibration of the strings. The more flexible the supporting structure of the instrument is, the higher the amplitude or potential volume of the produced musical tones.

There exists between the two considerations of the structure supporting the strings a direct opposition. Namely, opposition between the rigidity needed for long sustaining vibration and flexibility needed to produce audible volume in the form of vibrational amplitude. Conventionally, instruments are constructed in a manner which attempts to balance rigidity and flexibility to result in a musical instrument possessing both sustain and volume.

Typical guitars and similar instruments often employ a series of structural supports on the underside of the top or face of the instrument, commonly with two main supporting braces arrayed in an intersecting arrangement resembling the letter X. The X is oriented with the intersection of the braces centrally located on the underside of the face of the instrument, typically in front of the attachment point of the strings. These instruments will commonly utilize additional asymmetrical bracing in the area near and behind the attachment point of the strings to further stabilize the top of the instrument to prevent distortion from the tension imparted by the strings. This method is a compromise between the rigidity of the instrument's top and its flexibility and ability to vibrate. Another method of support commonly utilized in guitars possessing low tension nylon or gut strings utilizes multiple supporting bars with their origin near the sound hole of the instrument, parallel to the strings, or spayed out into the wider portions of the guitar's body.

SUMMARY OF THE INVENTION

The present invention generally relates to a guitar top. In one embodiment, the guitar top includes a sound hole, a neck end that is configured for attachment to a guitar neck with a longitudinal axis, a heel end, a transverse axis normal to the longitudinal axis, and a bottom surface. The bottom surface of the guitar top includes a pair of longitudinal braces that are attached to the surface. The pair of longitudinal braces extend primarily along the longitudinal axis from the heel end toward the neck end and terminate at a point beyond the sound hole toward the neck end. Each of the longitudinal braces is positioned on an opposing side of the sound hole such that a distance between the longitudinal braces exceeds the diameter of the sound hole. The longitudinal braces are oriented such that the distance between the pair of longitudinal braces is greater toward the neck end than the heel end. One or more fan braces extend primarily along the transverse axis, and at least one of the one or more fan braces terminate at one of the pair of longitudinal braces.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention relates to structural support members for the top of a stringed musical instrument, such as a flat top guitar. More particularly, the invention relates to a novel arrangement of structural support members, or braces that maximizes both the structural integrity and rigidity of the guitar and improves the ability of the instrument to amplify energy produced by the strings.

Figure 1:
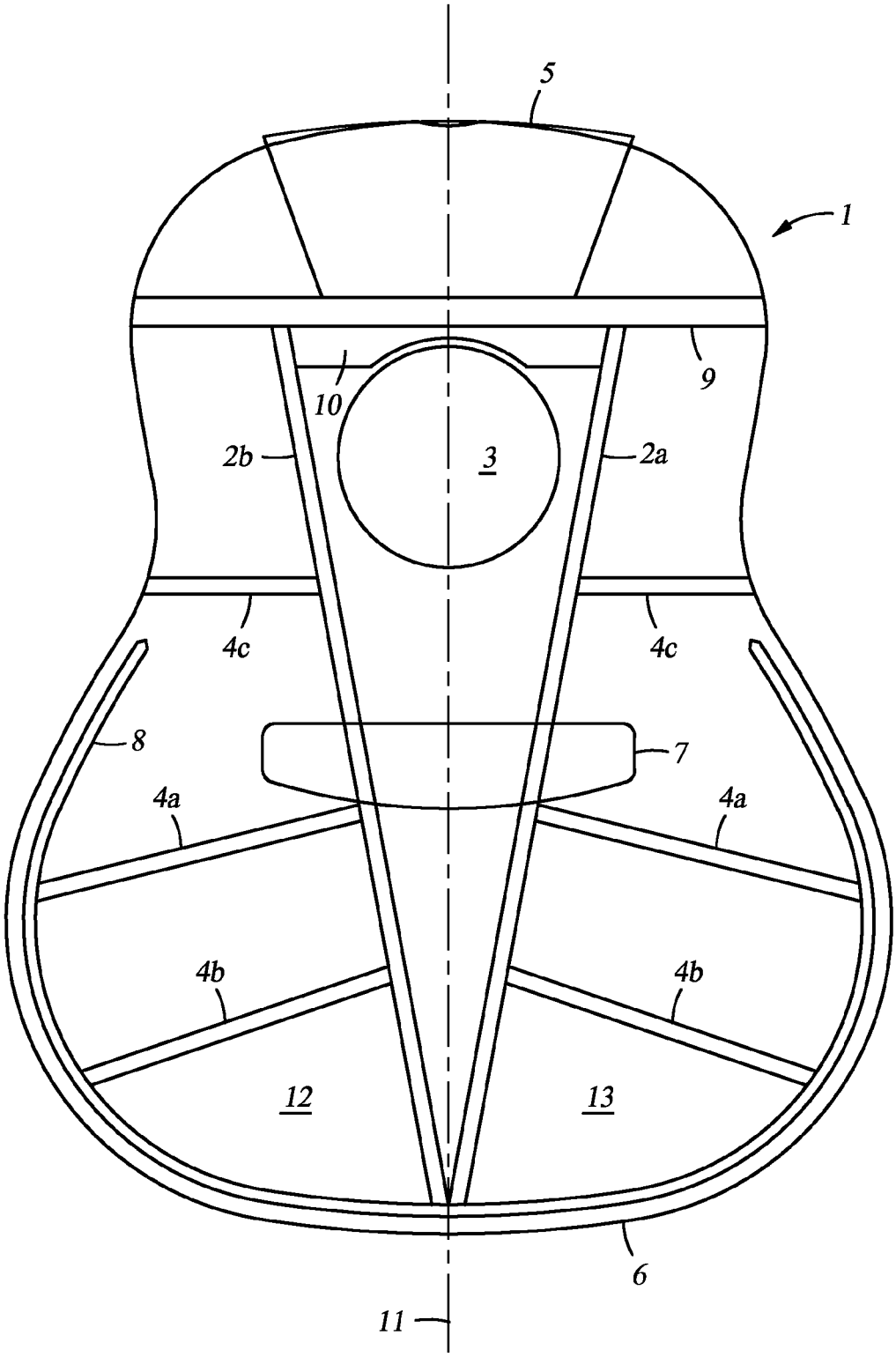
FIG. 1 is a plan view of the underside of a guitar top utilizing the bracing structure of a first embodiment of this invention.
Figure 2:
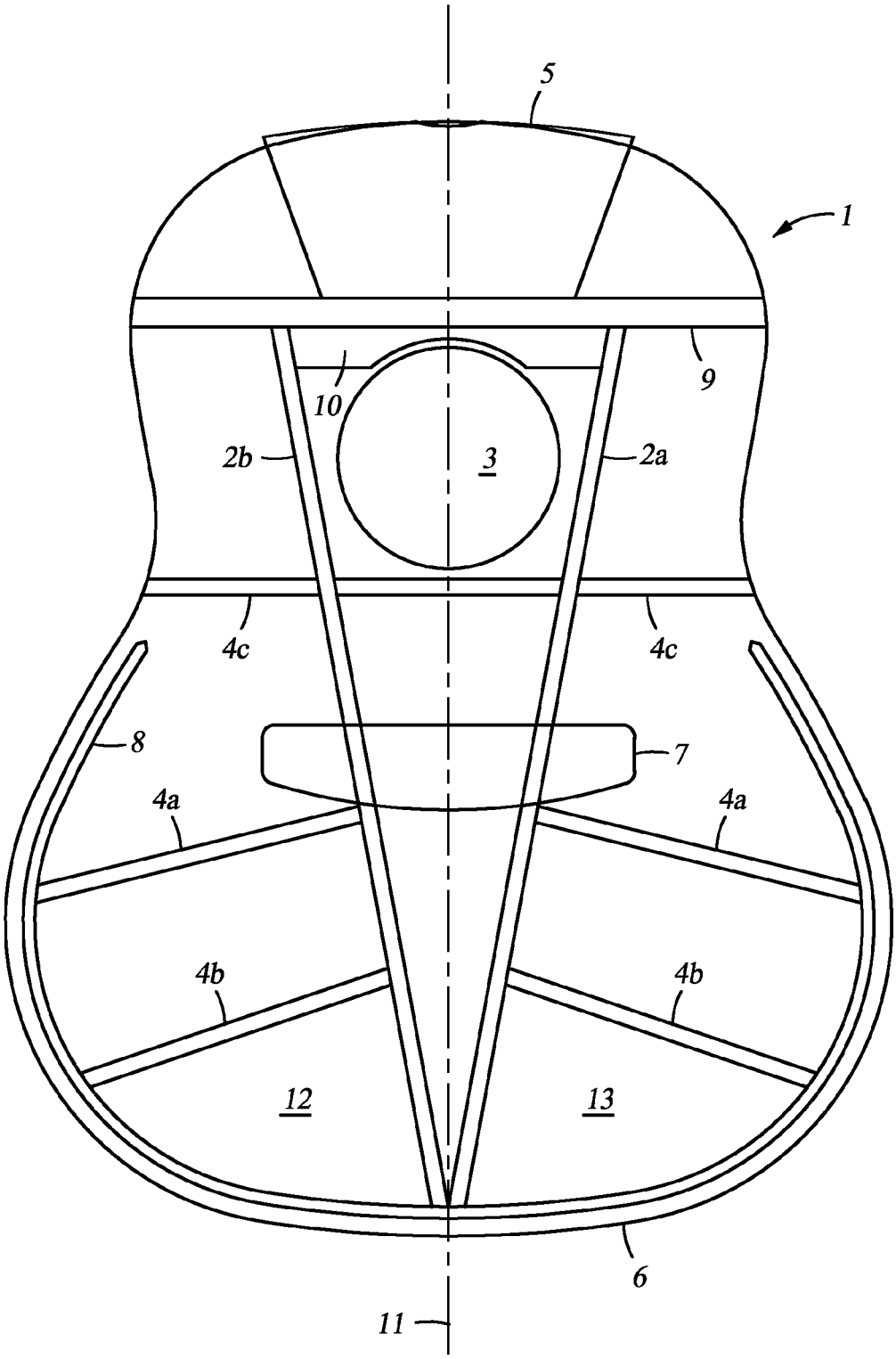
FIG. 2 is a plan view of the underside of a guitar top utilizing the bracing structure of a second embodiment of this invention.
Figure 3:
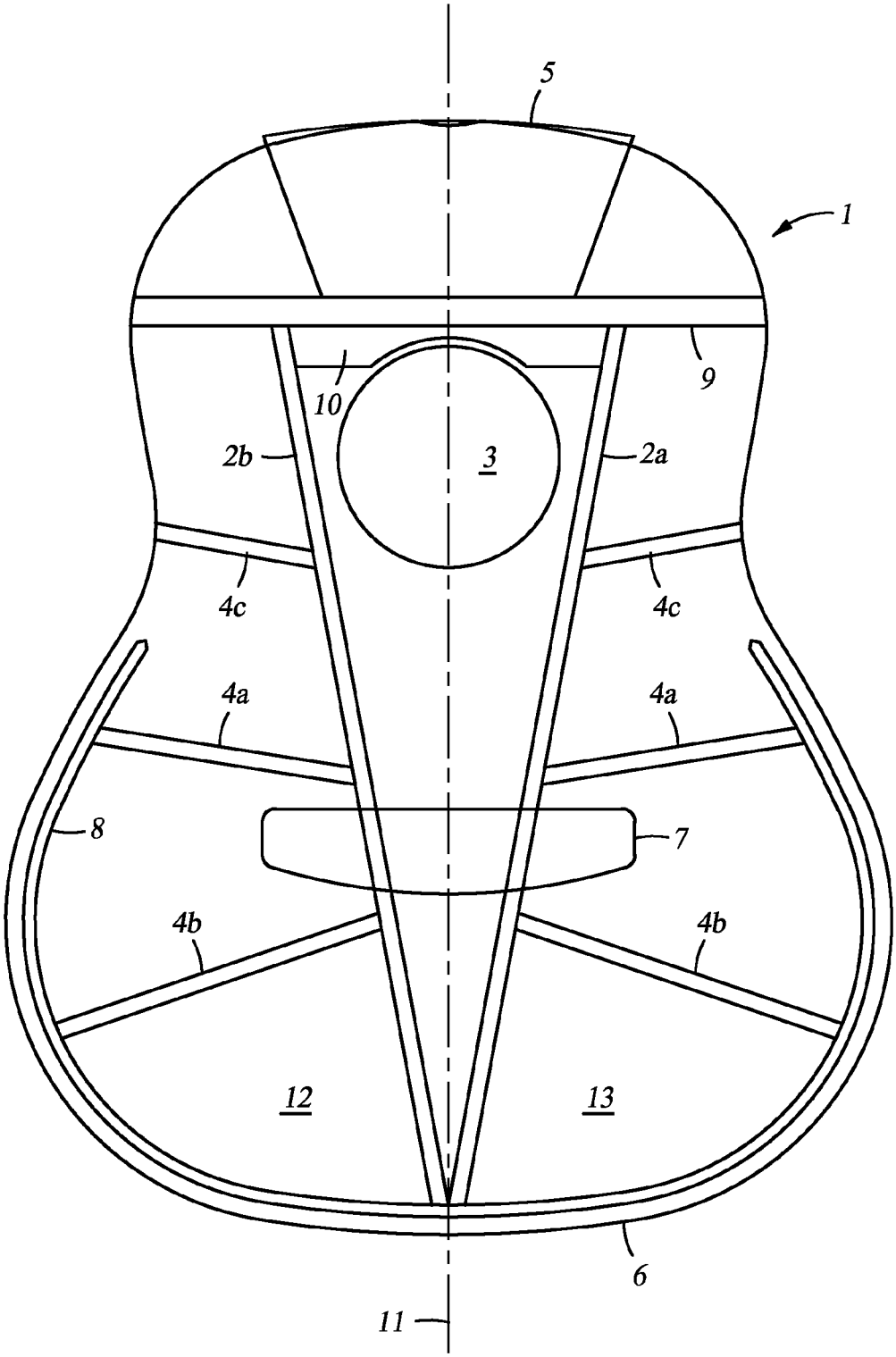
FIG. 3 is a plan view of the underside of a guitar top utilizing the bracing structure of a third embodiment of this invention.

FIGS. 1, 2, and 3 are plan views of a guitar top bracing structure according to three different embodiments of the invention. A guitar top 1, or soundboard, may have a top surface and a bottom surface with an end 5 proximate a neck of the guitar, an opposing end 6 proximate a heel of the guitar, and a longitudinal axis 11 aligned with the neck of the guitar. The top 1 may contain a round or oval sound hole 3 and a bridge plate 7 attached to the bottom surface of the guitar top 1. A pair of longitudinal braces 2*a*, 2*b* and one or more fan braces 4*a*, 4*b*, 4*c* affixed to the bottom surface of the guitar top 1, provide mechanical support to the guitar in resisting physical distortion due to the string tension and contribute to the conduction and distribution of vibration from the strings to assist in even vibration of the resonant chamber of the guitar. The longitudinal braces 2*a*, 2*b* and fan braces 4*a*, 4*b*, 4*c* influence the flexibility of the guitar top 1 and in turn influence the volume producing amplitude of the top 1. The longitudinal braces 2*a*, 2*b* and the fan braces 4*a*, 4*b*, 4*c* allow for independent control over the rigidity and volume producing, flexibility of the guitar top.

In the embodiments shown in FIG. 1, FIG. 2, and FIG. 3, longitudinal braces 2*a*, 2*b* extend along the guitar top 1 between the neck end 5 and the heel end 6. The longitudinal braces 2*a*, 2*b* may extend a partial length or a complete length of the guitar top 1 from the neck end 5 to the heel end 6. The longitudinal braces 2*a*, 2*b* may be continuous, or unbroken, along the full length of the guitar top 1. The longitudinal braces 2*a*, 2*b* are positioned primarily along the longitudinal axis 11. The longitudinal axis 11 may be along the centerline of the guitar top 1. Optionally, the longitudinal axis 11 may be offset from the centerline of the guitar top 1. The orientation of the longitudinal braces 2*a*, 2*b* is nonparallel, such that the distance between the longitudinal braces 2*a*, 2*b* is greater near the neck end 5 than near the heel end 6. The longitudinal braces 2*a*, 2*b* are positioned on each side of the sound hole 3 and extend past the sound hole 3 toward the neck end 5 to provide rigidity in this direction. The longitudinal braces 2*a*, 2*b* may extend to a fingerboard brace 9. A plate brace 10 may be positioned in the space formed between an edge of the sound hole 3 nearest the neck end 5, the fingerboard brace 9, and the longitudinal braces 2*a*, 2*b* straddling the sound hole 3. The fingerboard brace 9 and plate brace 10 may be constructed and positioned according to any method known in the art. Each longitudinal brace 2*a*, 2*b* forms an angle with the longitudinal axis 11 between 0 and 45 degrees, forming a V-shape with a vertex near the heel end 6. A preferred angle may be between approximately 5 and 20 degrees. In the embodiments shown, the angle is approximately 10 degrees. The longitudinal braces 2*a*, 2*b* are positioned such that the longitudinal braces 2*a*, 2*b* extend adjacent the sound hole 3 with the sound hole 3 situated within the V-shape. Preferably the longitudinal braces 2*a*, 2*b* would be positioned near an edge of the sound hole 3. An angle of the V-shape may be chosen in order to position the longitudinal braces 2*a*, 2*b* adjacent the sound hole 3. The angle of the V-shape and the distance between the sound hole 3 and the longitudinal braces 2*a*, 2*b* may vary depending on a position of the vertex of the V-shape relative the heel end 6, a distance from the sound hole 3 to the vertex, a diameter of the sound hole 3, a size and shape of the top 1, a length of the neck, and a scale length of the guitar. In the embodiments shown, the vertex of the V-shape is positioned substantially at an edge of the heel end 6 of the top 1. Other embodiments may position the vertex spaced from the edge of the heel end 6, or no vertex may be present if the longitudinal braces 2*a*, 2*b* do not intersect at any point on the guitar top 1. The sound hole 3 may be positioned along an axis of symmetry between the longitudinal braces 2*a*, 2*b*. Optionally the sound hole 3 may be offset from the axis of symmetry between the longitudinal braces 2*a*, 2*b*. As seen in the embodiments of FIG. 1, FIG. 2, and FIG. 3 longitudinal braces 2*a*, 2*b* may be positioned such that they contact the bridge plate 7. Preferably, the longitudinal braces 2*a*, 2*b* are morticed, or notched to fit over the bridge plate 7, and affixed to both the top 1, and the bridge plate 7. Alternately, the bridge plate 7 can be made in three pieces and fitting in between the longitudinal braces 2*a*, 2*b*, abutting the longitudinal braces 2*a*, 2*b*.

The guitar top 1 may have strings strung from a bridge to a headstock of the guitar. The strings may be composed of either nylon or steel. The tension applied by the strings to the guitar top 1 can distort the guitar, rendering it unusable. The longitudinal braces 2*a*, 2*b* attached to the guitar top 1 resist deformation by increasing the rigidity of the top 1 along the longitudinal axis 11. The longitudinal braces 2*a*, 2*b* may be fashioned in one of multiple ways that would alter either the rigidity of the braces or the ability of the braces to assist in the resistance of the guitar top 1 to deformation. The longitudinal braces 2*a*, 2*b* may be composed of a single material or a composite of two or more materials, such that the mechanical properties can be tailored to a specific embodiment of the invention. A preferred material may be wood. A thickness of the longitudinal braces 2*a*, 2*b* may be altered in order to vary the brace rigidity. The precise arrangement of the longitudinal braces 2*a*, 2*b* on the guitar top 1 may be altered, by increasing or decreasing the angle between the longitudinal axis 11 and each longitudinal brace 2*a*, 2*b* in order to increase or decrease the support provided by the longitudinal braces 2*a*, 2*b* along the longitudinal axis 11. The ability to make such modifications allows for precise control of the rigidity of the guitar top 1.

The one or more fan braces, 4*a*, 4*b*, 4*c* may be affixed to the bottom surface of the guitar top 1 in order to direct and distribute the vibration from the strings toward a center of a vibrating area or hemisphere 12, 13 of the guitar top 1. The hemispheres 12, 13 are permitted to vibrate and produce the necessary vibratory amplitude, generating audible volume. Modifying the fan braces 4*a*, 4*b*, 4*c* allows for control over the flexibility of the guitar top 1, and thus the audible volume produced by the guitar. The precise number and positions of the fan braces 4*a*, 4*b*, 4*c* could be varied depending on the specific embodiment of the invention.

In one embodiment, fan braces 4*a*, 4*b*, 4*c* may comprise pairs that share an axis of symmetry corresponding to the longitudinal axis 11 of the guitar top 1. In FIG. 1 three pairs of fan braces 4*a*, 4*b*, 4*c* are illustrated. As seen in FIG. 1, the fan braces 4*a*, 4*b* may abut the longitudinal braces 2*a*, 2*b* at substantially a perpendicular angle in the plane of the guitar top 1 or at an angle deviating from perpendicular by up to 20 degrees. Alternatively the fan braces 4*a*, 4*b* may abut the longitudinal braces 2*a*, 2*b* at an angle accommodated by another positioning of the fan braces 4*a*, 4*b* on the top 1. Optionally, the fan braces 4*a*, 4*b* may have a longitudinal component to their orientation. Preferably, the fan braces 4*c* may be aligned with a transverse axis lying in the plane of the guitar top 1, perpendicular to the longitudinal axis 11. In this manner, the fan braces 4*c* may abut the longitudinal braces 2*a*, 2*b* at a non-perpendicular angle and the angle at which fan braces 4*c* abut the longitudinal braces 2*a*, 2*b* may vary depending on the angle formed by longitudinal braces 2*a*, 2*b* with the longitudinal axis 11. Optionally, fan braces 4*c* may be unpaired as shown in the embodiment of FIG. 2.

As shown in the embodiment of FIG. 1, the fan braces 4*c* may extend from the longitudinal braces 2*a*, 2*b* to an outer edge of the guitar top 1. Alternatively fan braces 4*a*, 4*b* may extend from the longitudinal braces 2*a*, 2*b* to an outer bracing 8 or to another distance short of the outer edge of the guitar top 1. The fan braces 4*a*, 4*b*, 4*c* may abut longitudinal braces 2*a*, 2*b* and outer bracing 8 using any suitable method known in the art. The width and the thickness of the fan braces 4*a*, 4*b*, 4*c* could be any suitable dimension known in the art. The fan braces 4*a*, 4*b*, 4*c* could be constructed from wood, plastic, or other material or composite with desired mechanical properties to allow for an additional level of control over the flexibility of the guitar top 1.

The fan braces 4*a*, 4*b*, 4*c* may be positioned on the guitar top 1 relative to the sound hole 3 and the bridge plate 7. The one or more fan braces 4*a* may abut the longitudinal braces 2*a*, 2*b* proximate the bridge plate 7 toward the heel end 6 of the top 1. In this manner, fan braces 4*a*, 4*b* are positioned between the bridge plate 7 and the heel end 6. As seen in the embodiments shown in FIG. 1 and FIG. 2 multiple pairs of fan braces 4*a*, 4*b* may be positioned between the bridge plate 7 and heel end 6. Fan braces 4*a* may contact or nearly contact the bridge plate 7, or the fan braces 4*b* may be spaced a greater distance from the bridge plate 7 toward the heel end 6. As seen in the embodiment shown in FIG. 3, a single pair of fan braces 4*b* or optionally a single fan brace may be positioned between the bridge plate 7 and the heel end 6. This single pair or single fan brace 4*b* may contact or nearly contact the bridge plate, or the fan braces 4*b* may be spaced a greater distance from the bridge plate 7 toward the heel end 6. In the embodiments shown in FIG. 1, FIG. 2, and FIG. 3, the fan braces 4*a* and/or 4*b* positioned between the bridge plate 7 and the heel end 6 are substantially perpendicular to the longitudinal braces 2*a*, 2*b*. Optionally, in other embodiments of the invention the fan braces 4*a*, 4*b* could be positioned such that they are substantially parallel to the transverse axis or oriented at an alternative angle such that they are non-perpendicular to the longitudinal braces 2*a*, 2*b*.

The one or more fan braces 4*c* may abut longitudinal braces 2*a*, 2*b* between the bridge plate 7 and the neck end 5. As seen in the embodiment shown in FIG. 1 a single pair of fan braces 4*c* or as seen in FIG. 2 a single fan brace 4*c* may be positioned between the bridge plate 7 and neck end 5. In the embodiment shown in FIG. 2 fan brace 4*c* could be constructed of a single unbroken brace or three separate braces abutting the longitudinal braces 2*a*, 2*b*. Optionally, as seen in the embodiment shown in FIG. 3, multiple fan braces or multiple pairs of fan braces 4*a*, 4*c* can be positioned between the neck end 5 and bridge plate 7. The fan braces 4*a*, 4*c* positioned between the neck end 5 and bridge plate 7 could be spaced a distance from the neck end 5 and bridge plate 7 according to the layout of a specific embodiment. Alternatively, fan braces 4*a*, 4*c* could be spaced closer to either the neck end 5 or bridge plate 7. In the embodiment shown in FIG. 1, FIG. 2, and FIG. 3, fan braces 4*c* positioned between the bridge plate 7 and the neck end 5 are substantially parallel to the transverse axis. Optionally, in other embodiments of the invention fan braces 4*c* could be positioned such that they are substantially perpendicular to the longitudinal braces 2*a*, 2*b* or oriented at an alternative angle that is neither perpendicular to the longitudinal braces 2*a*, 2*b* nor parallel to the transverse axis.

Fan braces 4*c* may be positioned proximate the sound hole 3 toward the heel end 6. In the embodiments shown, the fan braces 4*c* are positioned near an edge of the sound hole 3 nearest the bridge plate 7. In other embodiments of the invention, the fan braces 4*c* could be positioned near other edges of the sound hole 3.

As seen in the embodiments shown in FIG. 1 and FIG. 3, fan braces 4*a*, 4*b*, 4*c* may extend exteriorly of the longitudinal braces 2*a*, 2*b* to an outer edge of the guitar top 1, leaving an interior region of the V-shape formed by the longitudinal braces 2*a*, 2*b* void of any fan braces 4*a*, 4*b*, 4*c*. Alternatively, fan braces 4*c* may intersect longitudinal braces 2*a*, 2*b* and extend interiorly of longitudinal braces 2*a*, 2*b* toward the longitudinal axis 11, as shown for fan braces 4*c* in the embodiment of FIG. 2.

The guitar top could be assembled with a guitar body and a guitar neck using any method known in the art. The guitar may contain additional components, such as electronics and other guitar components known in the art.

While the foregoing is directed to embodiments of the present invention, other and further embodiments of the invention may be devised without departing from the basic scope thereof, and the scope thereof is determined by the claims that follow.

The invention claimed is:

1. A guitar top comprising:

a sound hole;

a neck end configured to attach to a guitar neck having a longitudinal axis;

a heel end; and a transverse axis normal to the longitudinal axis;

wherein a bottom surface of the guitar top includes a pair of longitudinal braces attached to the surface, the pair of longitudinal braces extending primarily along the longitudinal axis from the heel end toward the neck end and terminating at a point beyond the sound hole toward the neck end, wherein each of the pair of longitudinal braces is positioned on an opposing side of the sound hole such that a distance between the longitudinal braces exceeds the diameter of the sound hole, and wherein the longitudinal braces are oriented such that the distance between the pair of longitudinal braces is greater toward the neck end than the heel end; and one or more fan braces extending primarily along the transverse axis, wherein at least one of the one or more fan braces terminates at one of the pair of longitudinal braces.

2. The guitar top of claim 1 wherein each of the pair of longitudinal braces is a single integral segment.

3. The guitar top of claim 1 having a bridge plate affixed to the bottom surface of the guitar top, wherein each of the pair of longitudinal braces contacts the bridge plate.

4. The guitar top of claim 1 wherein the pair of longitudinal braces comprises a first longitudinal brace and a second longitudinal brace and wherein the first and second longitudinal braces intersect and terminate at a reference point of the guitar, wherein the reference point is near the heel end of the guitar top.

5. The guitar top of claim 4 wherein the reference point is at the heel end of the guitar top.

6. The guitar top of claim 1 wherein fan braces do not extend between the pair of longitudinal braces.

7. The guitar top of claim 1 wherein one or more fan braces are positioned between the pair of longitudinal braces.

8. The guitar top of claim 1 wherein each of the one or more fan braces is positioned at an angle substantially perpendicular to one of the pair of longitudinal braces.

9. The guitar top of claim 1 wherein the pair of longitudinal braces and the one or more fan braces are symmetrical relative to the longitudinal axis.

10. The guitar top of claim 1 wherein each of the one or more fan braces extend from one of the pair of longitudinal braces to an edge of the bottom surface.

11. The guitar top of claim 9 wherein one or more fan braces comprise a pair of fan braces.

12. The guitar top of claim 11 comprising two or more pairs of fan braces.

13. The guitar top of claim 1 wherein the guitar top is assembled with a body and a neck to form a guitar, wherein the guitar comprises an electronic component.

14. A guitar comprising:

a neck having a longitudinal axis; and a body, the body comprising:

a top, the top comprising:

a sound hole;

a neck end configured to attach to the neck;

a heel end; and a transverse axis normal to the longitudinal axis;

wherein a bottom surface of the guitar top includes a pair of longitudinal braces attached to the surface, the pair of longitudinal braces extending primarily along the longitudinal axis from the heel end toward the neck end and terminating at a point beyond the sound hole toward the neck end, wherein each of the pair of longitudinal braces is positioned on an opposing side of the sound hole such that a distance between the longitudinal braces exceeds the diameter of the sound hole, and wherein the longitudinal braces are oriented such that the distance between the pair of longitudinal braces is greater toward the neck end than the heel end; and one or more fan braces extending primarily along the transverse axis, wherein at least one of the one or more fan braces terminates at one of the pair of longitudinal braces.

15. The guitar of claim 14 wherein each of the pair of longitudinal braces is a single integral segment.

16. The guitar of claim 14 having a bridge plate affixed to the bottom surface of the guitar top, wherein each of the pair of longitudinal braces contacts the bridge plate.

17. The guitar of claim 14 wherein the pair of longitudinal braces comprises a first longitudinal brace and a second longitudinal brace and wherein the first and second longitudinal braces intersect and terminate at a reference point of the guitar, wherein the reference point is near the heel end of the guitar top.

18. The guitar of claim 17 wherein the reference point is at the heel end of the guitar top.

19. The guitar of claim 14 wherein fan braces do not extend between the pair of longitudinal braces.

20. The guitar of claim 14 wherein one or more fan braces are positioned between the pair of longitudinal braces.

21. The guitar of claim 14 wherein each of the one or more fan braces is positioned at an angle substantially perpendicular to one of the pair of longitudinal braces.

22. The guitar of claim 14 wherein the pair of longitudinal braces and the one or more fan braces are symmetrical relative to the longitudinal axis.

23. The guitar top of claim 14 wherein each of the one or more fan braces extend from one of the pair of longitudinal braces to an edge of the bottom surface.

24. The guitar of claim 22 wherein one or more fan braces comprise a pair of fan braces.

25. The guitar of claim 24 comprising two or more pairs of fan braces.

* * * * *